US006647575B2

(12) United States Patent
Garstecki et al.

(10) Patent No.: US 6,647,575 B2
(45) Date of Patent: Nov. 18, 2003

(54) METHOD AND APPARATUS FOR REDUCING WASH TUB DISPLACEMENT DURING SPIN CYCLE RAMP-UP

(75) Inventors: Gregory Michael Garstecki, St. Joseph, MI (US); Eric Kenneth Farrington, Stevensville, MI (US); Tiemen Van Dillen, Schorndorf (DE)

(73) Assignee: Whirlpool Corporation, Benton Harbor, MI (US)

( * ) Notice: Subject to any disclaimer, the term of this patent is extended or adjusted under 35 U.S.C. 154(b) by 250 days.

(21) Appl. No.: 09/886,702

(22) Filed: Jun. 21, 2001

(65) Prior Publication Data

US 2002/0000010 A1 Jan. 3, 2002

Related U.S. Application Data

(60) Provisional application No. 60/213,682, filed on Jun. 23, 2000.

(51) Int. Cl.[7] ..... D06F 23/00; D06F 33/06

(52) U.S. Cl. ..... 8/159; 68/12.06; 68/23.2

(58) Field of Search ..... 8/159; 68/12.06, 68/23.2, 24

(56) References Cited

U.S. PATENT DOCUMENTS 5,345,792 A * 9/1994 Farrington et al. ..... 68/23.2
5,862,553 A 1/1999 Haberl et al. ..... 8/159
5,893,280 A 4/1999 Honda et al. ..... 68/12.06
5,907,880 A * 6/1999 Durazzani et al. ..... 8/159
6,546,354 B1 * 4/2003 Gayme ..... 702/147

FOREIGN PATENT DOCUMENTS

EP 0787847 A 6/1997 ..... D06F/37/22
EP 810316 A1 12/1997 ..... D06F/37/22
EP 878575 A1 11/1998 ..... D06F/37/22
EP 1167612 A2 * 1/2002

* cited by examiner

*Primary Examiner*—Randy Gulakowski
*Assistant Examiner*—Joseph Perrin
(74) *Attorney, Agent, or Firm*—Thomas J. Roth; Robert O. Rice; John F. Colligan

(57) ABSTRACT

A method for reducing displacement of a wash basket that is rotatable about an axis of rotation within a washing machine. The method comprises the steps of: mounting a balancing ring to the basket in the plane that is generally perpendicular to a rotation axis of the basket. Another step is supporting the wash basket by a tuned suspension structure to the machine and determining two resonance critical frequencies for two translational degrees of freedom and three resonance rotational frequencies for the three rotational degrees of freedom of the suspension structure. The method also comprises the step of tuning the suspension structure so that the two critical frequencies of translation each occur at or below a critical first motor speed and so that the three rotational frequencies occur at a second speed that is above the critical rotation speed.

17 Claims, 12 Drawing Sheets

METHOD AND APPARATUS FOR REDUCING WASH TUB DISPLACEMENT DURING SPIN CYCLE RAMP-UP

This application claims the benefit of Provisional Application No. 60/213,682 filed Jun. 23, 2000.

BACKGROUND OF THE INVENTION

The present invention is generally related to washing machines, and more particularly to a method and apparatus to reduce displacement of the wash basket that occurs at the beginning of a normal spin cycle during speed ramp up.

A common problem with washing machines, whether a horizontal axis, vertical axis, or tilt axis machine, is that the wash basket or rotary washing element of the machine experiences single unbalanced or single off balance load conditions during a wash cycle that affect rotation. The single unbalanced load condition is typically caused by an uneven distribution of laundry within the spinning wash basket. When the laundry within the wash basket is wet, it is relatively heavy which exaggerates any unbalanced condition. Rotation of the wash basket that carries an unbalanced or unevenly distributed load of laundry causes lateral displacement and vibration. Lateral displacement during the spin cycle is undesirable for a number of reasons including movement of the washing machine, noise, and premature wear and tear of washing machine components.

Many washing machines include an annular balancing ring that is mounted to the wash basket in order to reduce the amount of displacement during the spin cycle. A large component of a basket displacement occurs during speed and acceleration or ramp-up to the high-speed spin speed. Balancing rings are typically only designed to assist in correcting an unbalanced condition in a washing machine after the wash basket has reached full speed during the spin cycle.

One problem with conventional balancing rings is that the balancing mass providing the weight distribution correction actually adds to the unbalance of the wash basket prior to attaining a rotational speed that is greater than its present vibration frequencies. Attempts have been made to reduce the effects of this preliminary unbalanced phase of the ramp-up speed during the spin cycle.

European patent document EPO 787 847 A2 of Noguchi, et al discloses using a fluid balancing ring on a horizontal axis washing machine wherein the rotational speed of the fluid balancer is stepped-up from a first lower speed to a second higher speed in order to reduce the effects of the initial unbalance. Noguchi, et al this closes during a first lower rotational speed for a fixed time period and then ramping this speed up to the normal spin cycle speed. This first lower speed is run at a speed that is higher than the critical or resonance rotational speed of the fluid balancer, but lower than the critical or resonance rotational speed of the wash basket suspension system. Noguchi, et al does not address use of a ball balancer and further does not address the speed of the wash basket as it passes through the critical speed range of the suspension system.

U.S. Pat. No. 5,862,553 to Haberl et al. discloses a horizontal axis washing machine that uses a ball balancing ring for correcting imbalance in a rotating wash basket of the machine. Haberl et al. also discloses ramping up the rotation speed and specifically addresses the effect of gravity on the load within the horizontal axis washer. Haberl et al. attempts to compensate for the effect of gravity. In doing so, Haberl et al. initially drives the drum or wash basket and a continuous, relatively low, but variable speed wherein the speed variations are used to compensate for the effects of gravity on the unbalance of the wash basket. In horizontal axis washing machines, the unbalanced or heavy side of the wash basket speeds up by force of gravity as it falls and slows down by force of gravity as it climbs. The speed variation at the low speed of Haberl et al. attempts to compensate for this phenomenon.

Haberl et al. also discloses running the initial lower start up speed at a speed less than the speed at which resonance frequency of the wash basket occurs. Haberl et al. does not disclose addressing a particular resonance frequency for the suspension system for the wash basket.

SUMMARY OF THE INVENTION

One object of the present invention is to provide a method of reducing the effects of a single unbalanced or single off balance load condition in a wash basket having a balancing device during ramp up to a high-speed spin cycle. Another object of the present invention is to provide a method that reduces wash basket displacement during start up of the washing machine spin cycle. The further object of the present invention is to provide such a method for reducing this displacement during speed ramp-up that is equally useful for horizontal axis, vertical axis and tilt axis washing machines.

A still further object of the present invention is to provide such a method of reducing displacement of the wash basket during ramp-up of the high-speed spin cycle that particularly addresses large displacement of the wash basket caused by suspension system resonance. Another object of the present invention is to provide such a method of reducing displacement of a wash basket that is tuned to reduce the effects of cross over from a speed prior to reaching critical resonance frequencies of the wash basket suspension system to a speed that is above the these critical resonance frequencies. A further object of the present invention is to provide a suspension system that tunes the critical resonance frequencies to coincide with motor rotation speed in order to reduce the effect of the critical resonance frequencies on wash basket displacement.

These and other objects, features and advantages of the invention are provided by the method and apparatus disclosed herein. In one embodiment, a method is provided for reducing displacement of a wash basket of a washing machine that is rotatable about an axis of rotation within the machine. The washing machine has a drive motor that rotates the wash basket. The method includes attaching a balancing ring to the wash basket in a plane generally perpendicular to the rotation axis. The balancing ring has a balancing mass that is movable relative to the ring. The wash basket is then supported by a suspension structure to the washing machine. A resonance critical frequency is determined for each of two translational degrees of freedom that are in the plane of the balancing ring. Three other resonance frequencies are then determined for the three rotational degrees of freedom of the suspension structure. The suspension structure is tuned so that the two critical resonance frequencies of translation each occur at or below a critical first speed of the motor. The suspension structure is also tuned so that the three other frequencies of the rotational degrees of freedom occur at a second motor speed that is above the critical first speed. The motor is initially ramped up to an initial spin speed for rotating the wash basket wherein the initial spin speed is incrementally higher than the first critical motor speed and lower than the second motor speed. The motor is then held for a time period at the initial spin speed until the balancing mass moves relative to the ring to a correcting position opposite any imbalance of the wash basket. The motor is then finally ramped up to a final spin speed that is above the second motor speed for rotating the wash basket at the final spin speed.

In one embodiment, the method further includes ramping up the motor at a rate that permits the balancing mass to remain in the same correcting position relative to the balancing ring during ramp up and after reaching the steady state final spin speed.

In another embodiment of the invention, a washing machine includes a wash basket for rotation about an axis relative to the machine. A drive motor is mounted to the machine for rotating the wash basket. An annular balancing ring is mounted for rotation with the wash basket in a plane generally perpendicular to the rotation axis and has a balancing mass that is movable relative to the balancing ring. A suspension structure is mounted to the washing machine and supports the wash basket. The suspension structure has two critical resonance frequencies, one for each of two translational degrees of freedom of the suspension structure that lie in the plane of the balancing ring. The two critical resonance frequencies each occur at or below a first critical speed of the motor. The suspension structure also has three other resonance frequencies one for each of three rotational degrees of freedom of the suspension structure. Each of the three other resonance frequencies occur at or above a second motor speed that is higher than the first critical speed. The machine has the motor controller that can initially ramped up the motor to an initial spin speed that is incrementally higher than the first critical speed and lower than the second speed of the motor. The controller can dwell the motor at the initial spin speed at least until the balancing mass of the balancing ring is repositioned and stabilized to correct any imbalance in the wash basket. The motor controller can then ramp up the motor to a final spin speed that is higher than the second speed.

In one embodiment, The motor controller of the washing machine can ramped-up the motor at a rate that permits the balancing mass to remain in the same correcting position relative to the balancing ring while ramping up and after reaching the steady state final spin speed.

In each embodiment of the method and the apparatus, the axis of rotation may either be a vertical axis of a vertical axis washing machine, can be a horizontal axis of a horizontal axis washing machine, or can be a tilted axis of a tilted axis machine.

The present invention is directed to specifically tuned suspension structure for the wash basket wherein the translational resonance frequencies of two translational degrees of freedom that lie in the plane of the balancing ring occur at lower motor speeds than all three of the resonance frequency for the three rotational degrees of the system. The present invention also includes ramping up the speed of the wash tub to speed that is incrementally higher than the highest occurring motor speed of the two translational resonance frequencies but below the occurring motor speed for all three of the rotational resonance frequencies. By doing so, the balancing mass will shift from being disposed on the same side of the axis of rotation as an out of balance or heavy side of the wash basket, where it adds to the instability of the wash basket, to the opposite side of the rotational axis relative to the heavy side where it will reduce the imbalance. This transition typically occurs above both of the translational resonance frequencies for the two degrees of freedom that lie in the plane of the balancing ring. The present invention therefore reduces the amount of basket displacement, shaking, noise and vibration caused by the initial low rpm out of balance of most washing machines.

These and other objects, features and advantages of the present invention will become apparent upon reviewing the written description and the accompanying drawings. The foregoing and other objects of the invention are attained by the method and apparatus described herein that provide reduced displacement caused by an unbalanced load during start up of a wash basket in a washing machine during a spin cycle.

DETAILED DESCRIPTION OF THE PREFERRED EMBODIMENTS

Figure 1:
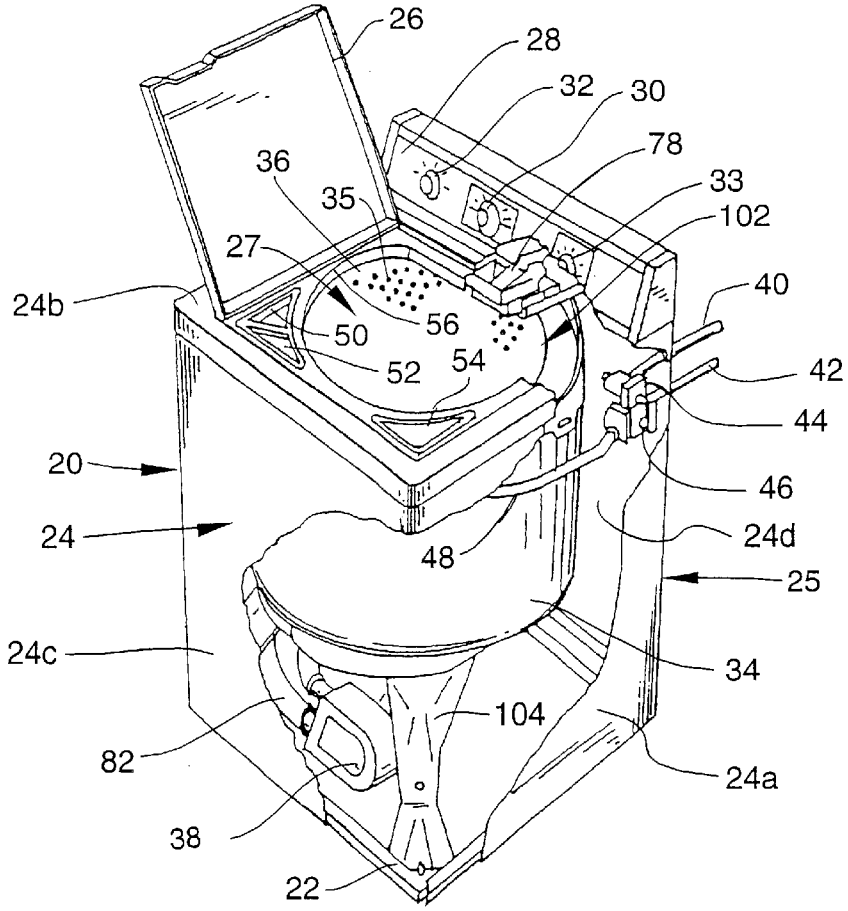
FIG. 1 is a general perspective view of an exemplary vertical axis to automatic washing machine partially cut away to illustrate various interior components.
Figure 2:
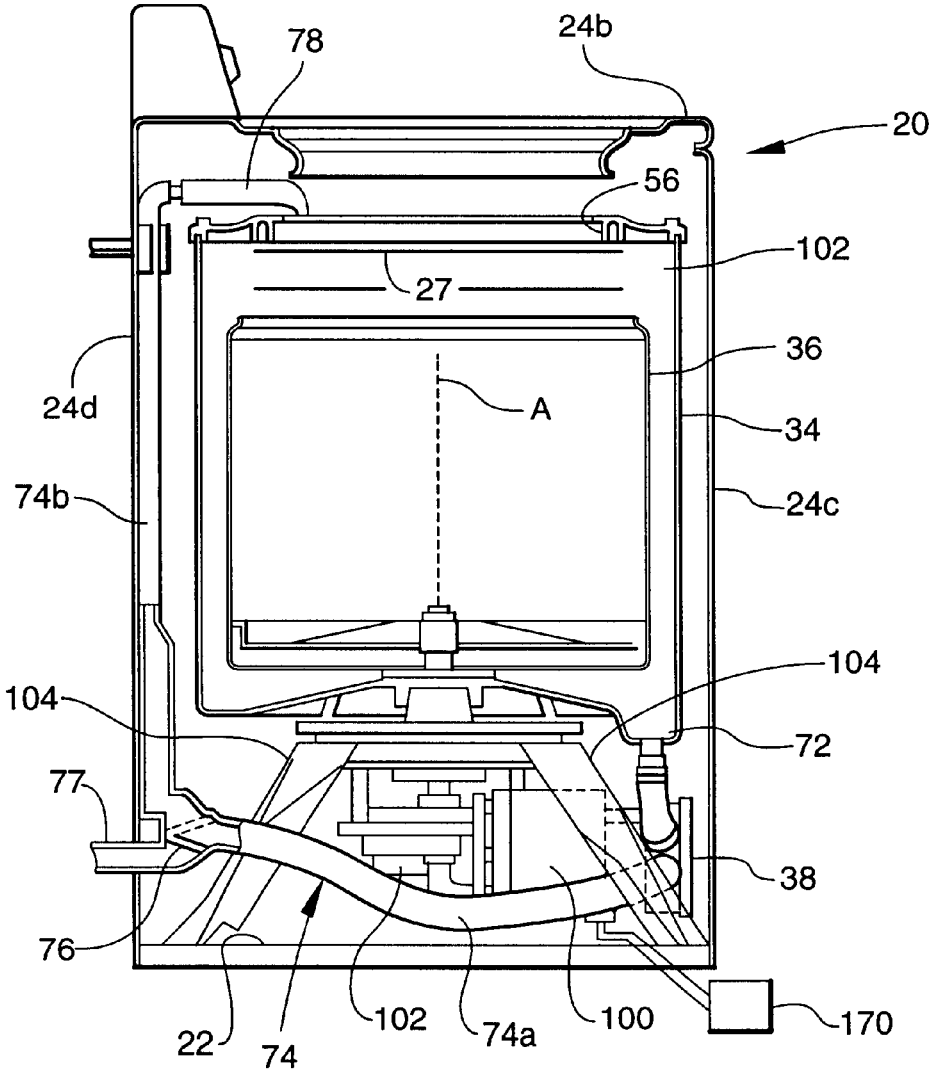
FIG. 2 is a side sectional view of the automatic washing machine of FIG. 1.

Referring now to the drawings, FIGS. 1 and 2 illustrate a vertical axis automatic washer construction for which the method and apparatus of the invention are useful. The automatic washer 20 generally refers to a washing machine having a pre-settable control for operating a washer through a pre-selected wash cycle program including automatic washing, rinsing and drying operations. During at least the drying operation, the washing machine 20 operates at relatively high rotational speeds in order to extract water from articles such as clothing that have been washed by the machine. This portion of a wash cycle is commonly known as the spin cycle.

The washing machine 20 includes a frame 22 carrying vertical panels 24, forming sides 24*a*, a top 24*b*, a front 24*c*, and a back 24*d* of a cabinet 25. A hinged lid 26 is provided in the usual manner for access to the interior or treatment zone 27 of the washing machine 20. The washer 20 also includes a console 28 having a timer dial 30 or other timing mechanism and a temperature selector 32 as well as a cycle selector 33 and other selectors as desired.

Internally, the exemplary washing machine also includes and imperforate tub 34 within which a wash basket 36 is received. The wash basket 36 is perforated including a number of holes 35 permitting fluid to pass between the wash basket interior and the tub. A pump 38 is provided below the tub 34. The wash basket 36 defines an open top wash chamber and has an upstanding sidewall 37. Baffles may be provided on the interior of the sidewall 37 or on an upstanding axial projection as is known in the art for agitating the water and articles within the wash basket during a wash cycle as is commonly known. A motor 100 is operatively connected to the wash basket 36 through a transmission 101 to rotate the wash basket 36 relative to the stationary tub 34. All of the components within the cabinet 25 are supported by a suspension structure or plurality of struts 104.

Water is supplied to the imperforate tub 34 by hot and cold water supply inlets 40 and 42. A hot water valve 44 and a cold water valve 46 are connected to a manifold conduit 48. The manifold conduit 48 is interconnected to a plurality of wash additive dispensers 50, 52 and 54 disposed around a top opening 56 above the tub 34, just below the lid 26. As shown in FIG. 1, the dispensers are accessible when the hinged lid 26 is opened. Dispensers 50 and 52 can be used for dispensing additives such as bleach or fabric softeners and dispenser 54 can be used to dispense detergent, either liquid or granular, into the wash load at an appropriate time during the automatic wash cycle. Each of the dispensers 50, 52 and 54 is typically supplied with liquid, generally freshwater, through separate dedicated conduits (not shown). Each of the conduits can be connected to a fluid source in a conventional manner, such as through respective solenoid operated valves (also not shown), which contain built-in flow devices to control flow rate, connecting each conduit to the manifold conduit 48.

Disposed at the bottom of the tub 34 is a sump portion 72 for receiving wash liquid supply into the tub through the wash additive dispensers 50, 52 and 54. A pressure sensor (not shown) is disposed in the sump 72 for controlling the quantity of wash liquid added to the wash tub 34. The pump 38 is fluidly interconnected with the sump 72 and is operable for drawing wash liquid from the sump 72 and moving the liquid through a recirculation line 74 having a first portion 74*a* and a second portion 74*b*. A two-way drain valve 76 is provided in the recirculation line 74 for alternately directing wash liquid flow to a drain line 77 or to the second portion 74*b* of the recirculation line 74.

A nozzle 78 is fluidly connected with a recirculation line 74. The nozzle 78 extends beyond the top opening 56 of the tub 34 and is positioned above the wash basket 36 such that wash liquid flowing through the recirculation line 74 is sprayed into the basket 36 and on to clothes disposed in the basket below the nozzel 78. Wash liquid can therefore be recirculated over clothing disposed in the wash basket 36.

The above described general description of a vertical axis washing machine 20 is provided for illustration only. As will be evident to those skilled in the art, the general construction of the machine 20 can vary considerably without departing from the spirit and scope of the present invention. However, the wash basket 36 includes a balancing ring 102 carried on a top end 103 of the upstanding sidewall 37 of the basket. The balancing ring 102 is described in greater detail below.

Figure 3:
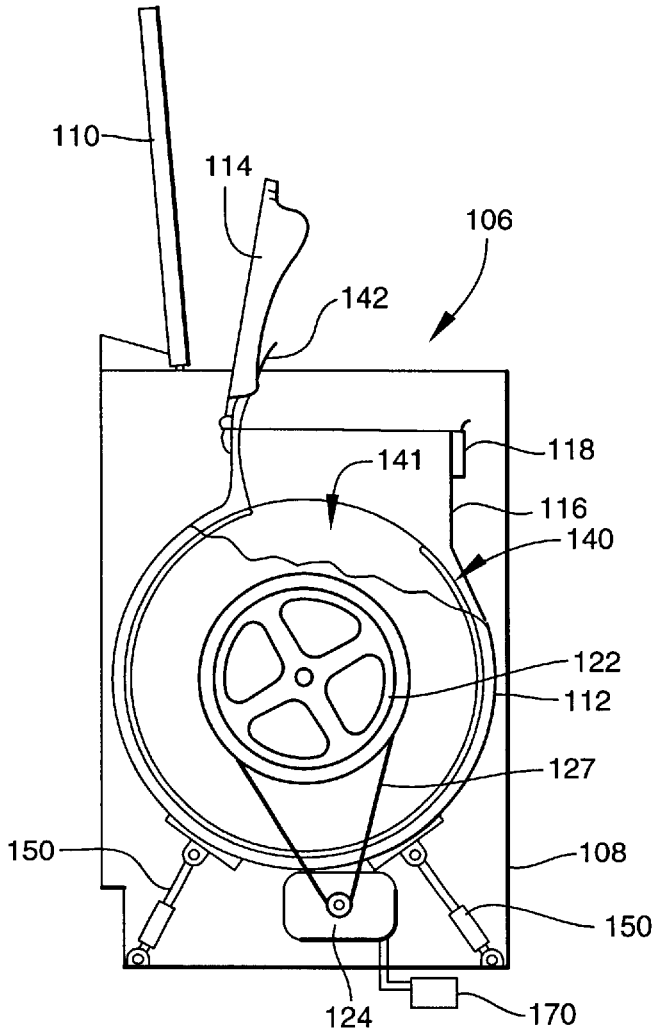
FIG. 3 is a partially cut away side view of an exemplary horizontal axis washing machine.

In FIG. 3, there is illustrated an exemplary top loading horizontal axis or drum-type automatic washer for which the method and apparatus of the present invention are equally well suited. The washer 106 has an outer cabinet 108 with an openable lid 110, shown in an open position which encloses an imperforate wash tub 112 for receiving a supply of wash liquid. The wash tub 112 has an upwardly orientated access portion 116 and a wash tub lid 114, shown in an open position, disposed at the top of the axis portion 116. A locking mechanism 118 is provided for maintaining the wash tub lid 114 in a closed and locked position during washing.

Disposed within the wash tub 112 is a rotatable, perforate wash drum or basket 140 having an openable access door 142 for alignment with the access portion 116. The access door 142, shown in an open position, provides an opening 141 for allowing access into the wash drum 140 such that clothes may be loaded and unloaded from the wash drum or basket 140. The wash drum 140 is termed as a wash basket herein to simplify the description of the invention. Whether a vertical or horizontal axis washer herein, the perforate, rotatable portion of the washer is identified as a basket herein.

Figure 4:
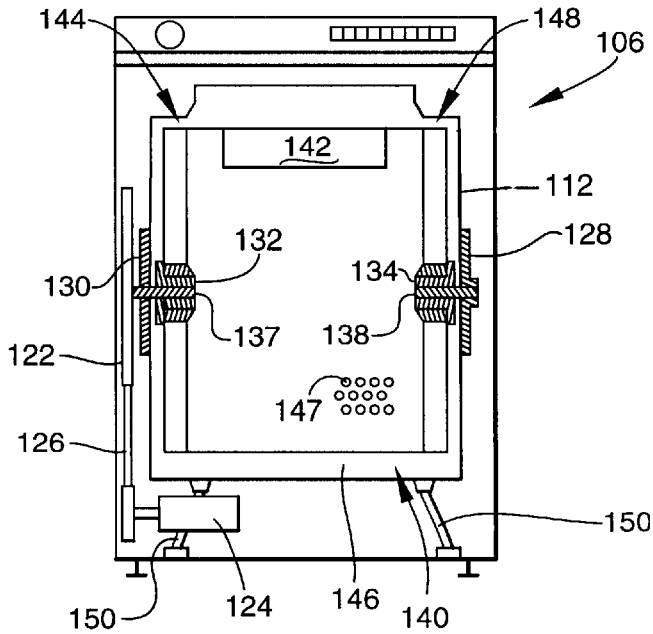
FIG. 4 is a partially cut away front view of the washing machine of FIG. 3.

A front view of the top loading automatic washer 106 is shown in FIG. 4. A motor 124 is shown driveably connected to a pulley 122 by a belt 126. A drive shaft 137, rotatably supported by a first bearing means 130 interconnected with the wash tub 112, is provided having a first end drivingly connected to the pulley 122 and a second and drivingly connected to a first hub member 132. The first hub member 132 is rigidly connected to a first balancing ring 144 of the rotatable wash basket 140 such that the motor 24 is drivingly interconnected with the wash basket 140. A second hub member 134, rigidly connected to a second balancing ring 148 of the wash basket 140, is drivingly connected to a support shaft 138. The support shaft 138 is rotatably supported by a second bearing means 128 interconnected with the wash tub 112. This system, therefore, drivingly connects the motor 124 with the rotatable basket 140 and allows the basket 140 to rotate freely within the imperforate wash tub 112.

The general construction of the rotatable basket 140 of the present invention is shown in FIG. 4, where it cannot be seen that the wash basket 140 is constructed of a cylindrical outer wall 146, the first balancing ring 144 and the second balancing ring 148. The cylindrical outer wall defines a horizontal longitudinal axis of the wash basket 140 and includes a plurality of perforations or holes 147. The first balancing ring 144 is rigidly interconnected with a first end of the cylindrical outer wall 146 to form a first end wall of the wash basket 140. The second balancing ring 148 is rigidly interconnected with a second end of the cylindrical outer wall 146, opposite the first end, to form a second end wall of the wash drum 140. This construction of the wash basket 140 allows for adequate extraction of washing liquid during wash basket 140 spinning. Further, the balancing rings 144 and 148, being disposed along the ends of the perforate cylindrical outer wall 146, do not prevent or obstruct the extraction of water through the plurality of perforations 147 in the outer wall 146. Preferably the access door 142 may be proportioned to span across substantially the entire width of the cylindrical outer wall 146 so as to maximize access into the interior of the wash basket.

The horizontal axis washer 106 illustrated in FIGS. 3 and 4 incorporates a suspension structure 150 including a plurality of struts supporting the components within the machine. The above description of a horizontal axis washing machine 106 is provided for illustration only. As will be evident to those skilled in the art, the general construction of each of the machines 20 and 106 can vary considerably without departing from the spirit and scope of the invention. For example, many horizontal axis machines are front loading such as in commercial settings and laundromats. In contrast, the machine 106 is a top loading horizontal axis machine. Also, some machines spin on an access that is tilted relative to a horizontal and a vertical reference. These alternative machine constructions can incorporate the method and the apparatus of the invention. The present invention is directed to a method and an apparatus for reducing the wash basket displacement characteristics for any type of washing machine having a rotary wash basket and particularly for reducing wash basket displacement during start up of a high-speed spin cycle.

Figure 5A:
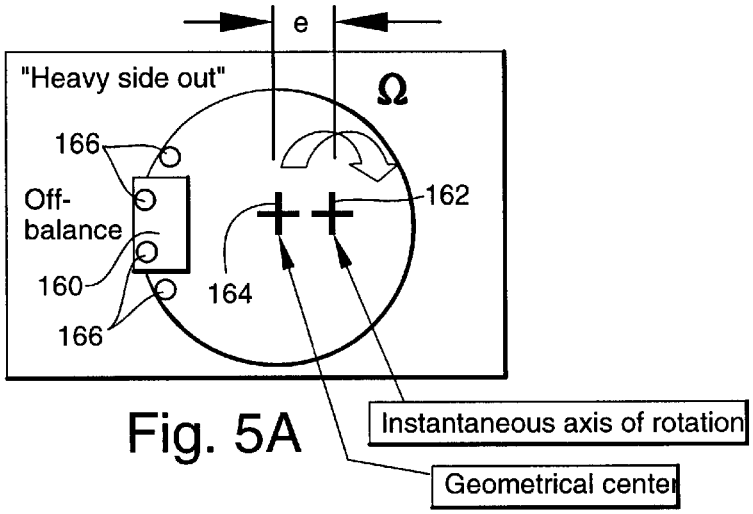
FIG. 5A is a schematic representation of a single off-balance in a wash basket of a washing machine wherein the heavy side is opposite the off-balance axis of rotation.
Figure 5B:
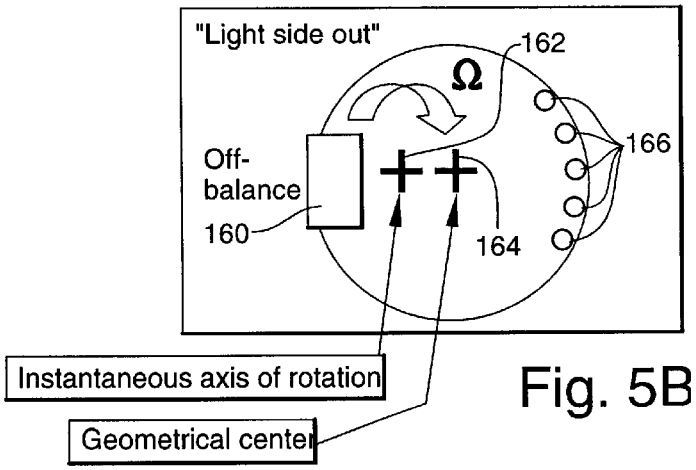
FIG. 5B is a schematic representation of a single off-balance in a wash basket of a washing machine wherein the heavy side of the wash basket disposed on the same side of the off-balance axis of rotation.

FIGS. 5A and 5B schematically illustrate either a top view of the wash basket 36 of the washing machine 20 or a side view of the horizontal axis wash basket 140 of the washing machine 106. In either washing machine, the motor 100 or 124, respectively, will drive and rotate the wash basket during operation of the respective washing machines. During a spin cycle of each washing machine, the wash basket rotates at a relatively high rate in order to extract water through the perforations 35 or 147 in the respective wash baskets 36 or 140 through the wash basket in into the respective wash tub, 34 or 112, surrounding the basket in order to at least partly dry the clothing or other objects held within the basket.

Figure 6A:
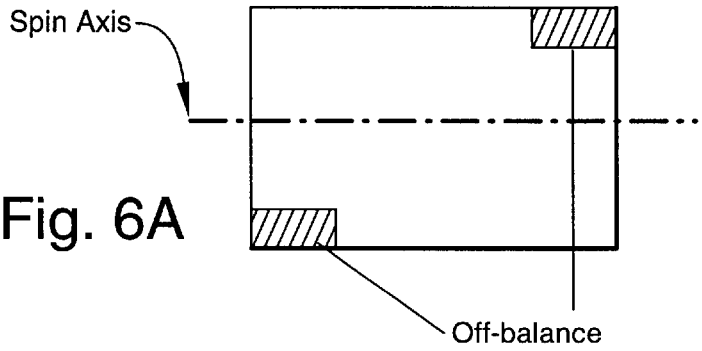
FIGS. 6A–6D are each a schematic of different types of off-balance conditions in a wash basket of a washing machine.
Figure 6B:
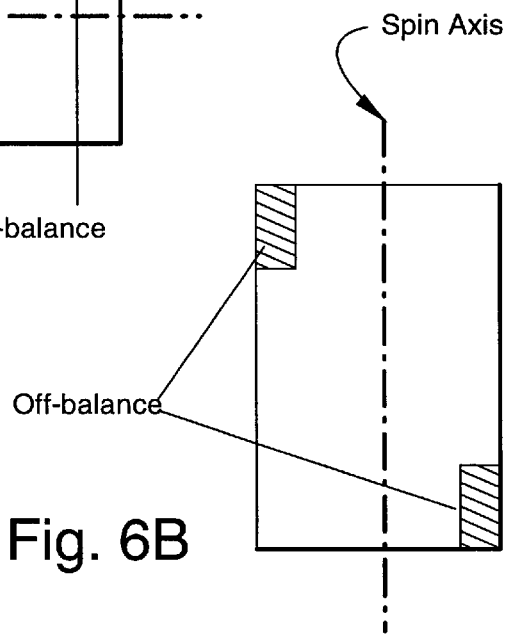
Figure 6C:
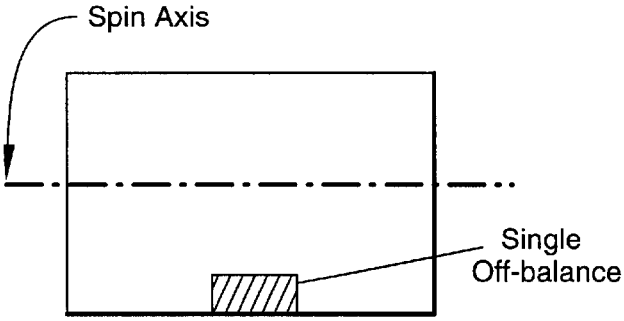
Figure 6D:
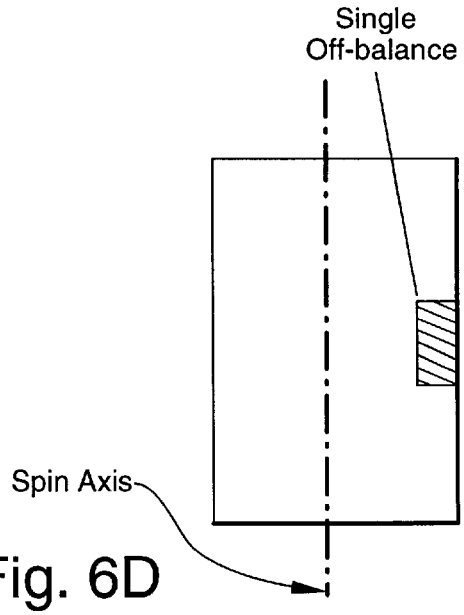

It is then discovered that when the motor and hence the wash basket is ramped up to speed for a high-speed spining cycle, the wash basket goes through a transition that causes large displacement of the wash basket. This transition is caused by out of balance load distributions created by the unevenly distributed laundry or other objects held in the basket. FIGS. 6A–6D illustrate various possible out of balance conditions. FIG. 6A shows a schematic horizontal axis wash basket with a three dimensional or "dynamic" out of balance condition. FIG. 6B shows a schematic vertical access wash basket with a three dimensional or "dynamic" out of balance condition. FIGS. 6C and 6D show schematic horizontal and vertical axis wash baskets, respectively, with a two dimensional or single out of balance condition. The present invention is directed to correcting the single off-balance conditions for horizontal or vertical axis washers as illustrated in FIGS. 6C and 6D, and for tilt axis machines as well.

When a single off balance or unbalanced load exists in a rotating wash basket, the axis of rotation 162 for any instantaneous moment in time does not align with the nominal or geometric center of 164 of the basket. A heavy side 160 of a single out of balance or unevenly distributed load within the wash basket tends to "throw" the wash basket off the geometrical center 164 causing wash basket displacement during rotation.

At very low speeds, it has been discovered that the instantaneous axis of rotation 162 is positioned away from or on the opposite side of the geometrical center axis 164 relative to the heavy side 160 of the single off balance load. This condition is illustrated in FIG. 5A and is characterized herein as the wash basket spinning "heavy side out" for ease of description. At faster speeds, it has been discovered that the instantaneous axis or rotation 162 is positioned closer to the heavy side 160 of the off balance load of the wash basket and therefore is positioned between the geometric center axis 164 and the off-balance 160. This condition that is characterized herein as the wash basket spinning "light side out" for ease of description. Depending upon the speed of rotation a given moment in time and depending upon the magnitude of the off-balance 160 for a given load within a wash basket, the instantaneous distance between the geometric center 164 and the instantaneous access of rotation 162 is identified as the eccentricity ($\epsilon$) of the load. There is a point in time as the motor speed ramp is up from zero to full speed wherein the wash basket transitions from the low speed heavy side out condition to the high-speed light side out condition. At this transition point, the eccentricity or $\epsilon$ is equal to zero wherein the instantaneous axis of rotation 162 and the geometric center 164 are one in the same and coaxial.

The vertical axis washing machine 20 illustrated in FIG. 1 includes at least one balancing ring 102 disposed at the top edge 103 of the wash basket 36. A number of different types of balancing rings are known in the art but can include a LeBlanc fluid balancing ring wherein the ring includes a hollow annular chamber with the chamber volume and also includes a balancing fluid defining a balancing mass 166 held therein. The fluid is typically takes up about ½ of the volume of the balancing ring chamber. Another type of balancing rings known in the art is termed a ball balancer and includes a hollow annular chamber containing a number of weighted balls as the balancing mass. A viscous fluid is also held within the chamber taking up the remainder of the volume that tends to dampen or temper the movement of the balls within the chamber without preventing their movement altogether. The balls can be replaced by virtually any type of mass that rolls or slides such as cylinders or discs. The balancing mass within any type of balancing ring can move within the chamber and re-distribute as necessary to off-set an imbalance or heavy side within the wash basket 36.

The horizontal axis washing machine 106 of FIGS. 3 and 4 includes a pair of the balancing rings 144 and 148 disposed on opposite ends of the wash basket 146 for symmetry. The balancing rings 144 and 148 can also be any type of known balancing ring including a LeBlanc fluid balancer or a ball balancer. Because gravity can affect load distribution in a horizontal axis washing machine, a ball balancer utilizing the weighted balls and the viscous fluid tends to function better for this type of machine.

The washing machine 20 has a vertical axis about which the wash basket 36 rotates. The balancing ring 102 is arranged at the top edge 103 of the basket 36 and lies generally in a plane that is perpendicular to the vertical axis A and is concentric with the geometric center 164 that is also aligned with the vertical axis A.

In the horizontal axis washing machine 106, the axis of rotation of the wash basket 146 lies generally horizontal.

Each of the balancing rings 144 and 148 defines a plane separate but generally parallel to one another. Each of the planes defined by the balancing rings 144 and 148 is also generally perpendicular to the horizontal axis of the wash basket 146. For a tilted axis machine, each balancing ring defines a plane that is tilted relative to a horizontal and a vertical reference but is again generally perpendicular to the tilted spin axis of the wash basket.

A moment in time occurs where the wash basket in either washing machine embodiment goes through a transition from the heavy side out condition at low motor speeds to the light side out condition at higher motor speeds. This moment occurs when the motor achieves certain speeds that relate to particular natural frequencies of the suspension structure is of the washing machine. In these examples, the washing machine 20 includes suspension structures or struts 104 that support the components of the washing machine including the wash basket 36. The suspension structures or struts 150 support the horizontal axis wash basket 146 in the washing machine 106. Two critical natural frequencies of the suspension systems are the transitional if natural frequencies that are perpendicular to the axis of rotation of the wash basket in either machine construction. By arbitrarily defining a horizontal axis passing side-to-side through the washing machines as an X-axis, a horizontal axis that is perpendicular to the X-axis and passes front-to-back to each washing machine as a Y-axis, and a vertical axis of each machine as the Z-axis, the two critical natural frequencies for the translational degrees of freedom of interest in each machine construction can be defined. For the vertical axis machine of FIGS. 1 and 2, the two critical natural frequencies of the suspension structure are for translation along the X-axis and the Y-axis. Each of these axes is perpendicular to the vertical Z-axis and generally lies in the plane of the balancing ring 102. For the washing machine 106, the two translational degrees of freedom of interest are the Y-axis and the Z-axis translation all movements. The X-axis lies generally parallel to the horizontal axis of the wash basket 146. The Y-axis and Z-axis each is generally perpendicular to the horizontal axis and each generally lies parallel to the plane of the balancing rings 144 and 148.

The transition point occurs where the eccentricity $\epsilon$ equals zero when the wash basket transitions from the heavy side out to the light side out condition. This occurs when the explorer motor speed of the washing machine achieves the speed at which the two critical natural frequencies occur. Again, these are the frequencies for the translational degrees of freedom that are perpendicular to the rotation axis of the wash basket. This transition point changes the positioning of the balancing mass 166 of the balancing ring, either of the ring 102 or the rings 144 and 148, with a mass shifts one side of the geometric center axis 164 to the other.

To explain this phenomenon, forces acting on the balancing mass tends to "throw" the balancing mass away from the instantaneous real axis of rotation of the rotating wash basket. In reviewing FIGS. 5A and 5B, it is apparent that for the low speed heavy side out condition, the balancing mass moves to the furthest outside radius relative to the instantaneous axis of rotation and therefore aligns with the heavy side or imbalance in the wash basket, as shown in FIG. 5A. At low speeds, the balancing mass of the balancing ring therefore adds to the imbalance of the wash basket and thus adds to the displacement of the wash basket and to the vibration and movement of the washing machine while ramping up the spin cycle speed. Upon achieving the faster speed when the motor surpasses the critical first speed of the two translational degrees of freedom, the wash basket changes over to the light side out condition. The balancing mass then shifts as is illustrated in FIG. 5B to a position opposite the off-balance or imbalance 160 of the wash basket. This is because the instantaneous axis of rotation has moved closer to the off-balance. The balancing mass of the balancing ring always wants to move the furthest distance that it can from the instantaneous axis of rotation caused by the forces acting upon the mass.

It is a goal of the present invention to reduce the effects of the lower speed imbalance characteristics that are enhanced by the balancing mass aligning with the heavy side 160 of the wash basket as illustrated in FIG. 5A. The present invention is directed to a method and apparatus that significantly reduces the displacement of the wash basket during these lower speeds as the motor ramps up to the steady state final spin cycle speed for the washing machine.

Figure 7:
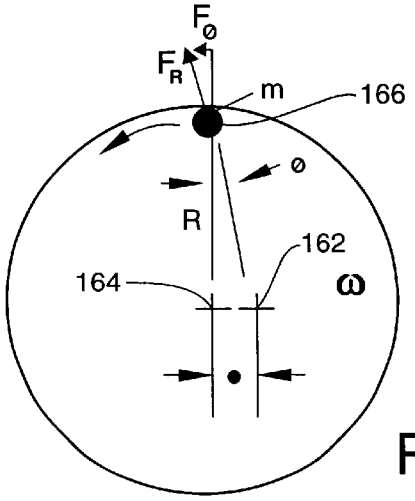
FIG. 7 is a schematic representation of forces imposed on the balancing mass of the balancing ring of the wash basket schematically illustrated in FIGS. 5 and 6.

FIG. 7 illustrate the schematic view of the forces interacting on the balancing mass of the balancing ring for a wash basket that is rotating with an out of balance or imbalanced load. For a ball balancer example, when the balancing ring is rotating, the drive forces that are imposed on each ball occur because of friction between the ball and the surfaces of the ring as well as the fluid this viscosity interacting with the ring interior chamber surfaces and the surfaces of the balls. A tangential force also acts upon each of the balls due to the offset or eccentricity of the axis of rotation as noted above. As illustrated in FIG. 7, the tangential force $F_{\varnothing}$ axis on each ball to move the ball relative to the ring so that the ball will move to the for this radius relative to the instantaneous axis of rotation. This tangential force is determined by the following equation:

$$F_{\varnothing}=F_R \sin(\varnothing)$$

Known elements for this equation are the eccentricity $\epsilon$ and a moment time, the angular velocity $\omega$, the radius from the geometric center to the balancing mass R, and the weight of the balancing mass m. And known elements are the angle ($\varnothing$) the actual force vector $F_R$ and the tangential force $F_{\varnothing}$ acting on the balancing mass. By direct substitution, $$\mathrm{Tan}(\varnothing)=\epsilon/R$$

The force factor $F_R$ can be determined using the following equation:

$$F_R=((\epsilon^2+R^2)^{0.5})*\omega^2*m$$

and by the direct substitution the instantaneous tangential force acting on the imbalance mass utilizing the equation:

$$F_{\varnothing}=((\epsilon^2+R^2)^{0.5})*\omega^2*m*[\epsilon/((\epsilon^2+R^2)^{0.5})]$$

The intent of the present invention is to reduce wash basket displacements during the low speed portion of the motor ramp up during a high speed spin cycle of a washing machine. The speed ramp up profile for the wash basket for either washing machine 20 or 106 has a major effect on the balancing ring 102 and the rings 144 and 148, respectively. The speed at which the balancing mass within the balancing rings reacts is dependent upon the "drag" of the mass within the ring. If the drag forces are high, the balancing mass will take longer to react to the natural frequencies of the overall system, which would thus result in large displacements during ramp up of the motor speed. If the drag forces are acting on the balancing mass are small, and the ramp up profile or acceleration to full speed is fast, the balancing mass may slip and overreact relative to the system natural frequencies and again add to the overall imbalance of the wash basket. If the drag forces are small and the ramp up profile to a maximum speed is slow, wash cycle time is increased because the total spin time is greater to accommodate for the slow ramp up.

It is therefore best to have some drag forces acting on the balancing mass within the balancing ring of a particular washing machine. Is further best to control the speed ramp up profile of the motor for the washing machine according to the invention. Is preferred that a variable speed controller 170 be in communication with the motor of the washing machine wherein the controller drives the motor at a controlled rate and can hold or dwell the motor speed for a predetermined period of time at a chosen speed.

A particularly important aspect of the present invention is to tune the suspension structure, either the structures 104 of the vertical axis machine 20 or the structures 150 of the horizontal axis machine 106, so that the three natural frequencies of the rotational degrees of freedom occur at higher motor speeds than at least the two critical natural frequencies of the translational degrees of freedom that are perpendicular to the rotation axis of the wash basket. By turning the suspension structure in such a manner, the critical natural frequencies that cause unwanted displacement during ramp up of the wash basket rotational speed can be accommodated in a controlled manner prior to reaching the final spin speed for the spin cycle. By controlling ramp up at the initial low speeds for the two critical natural frequencies of translation, the balancing mass of the balancing ring can transition from the heavy side out condition to the light side out condition under control and prior to running the wash basket to full speed. Running the motor at a lower speed and hence spinning the wash basket and a lower speed before and during the transition to the light side out condition reduces the overall effect of the heavy side out condition and hence reduces the displacement of the wash basket. A suspension structure such as the struts 104 or 150 of the respective machines 20 or 106 herein must therefore be carefully designed so that the natural frequency of each of the six degrees of freedom of the system are known, and so that the two critical natural frequencies of translation occur at low motor speeds and prior to the other less critical natural frequencies.

The next step is to determine the overall drag forces acting on the balancing mass within the balancing ring. These can be determined, such as for a LeBlanc fluid balancer, by determining the volume of the balancing ring interior chamber, the volume of fluid, the fluid mass, and the fluid viscosity. This can be determined, such as for a ball balancer, by determining the fluid viscosity, the size and mass of the balls, the volume of fluid and the balls, the volume of the interior chamber of the ring the and clearances between the chamber inner surfaces and the balls as well as other factors. The balancing rings can then be tuned, depending upon the desired ramp up profile of the motor speed, as described below, so that the balancing mass is not too slow to react and does not overreact in a given system. It is desired that the balancing mass be able to transition from the heavy side out condition to the light side out condition as quickly as possible and then "lock-up" with the ring at the proper position relative to the balancing ring without undershooting or overshooting. The balancing mass must be able to lock-up with the basket during initial start up or ramp up in yet be able to move as necessary during steady state spin conditions of the wash basket.

The next up is to develop the speed profile for the motor controller 170 that will ramp up the motor to an initial spin speed that is just higher than the first critical speed of the motor at which the two critical natural frequencies of the suspension structure occur. The speed profile of the controller should then dwell the motor speed for a period of time at the initial speed so that the balancing mass can lock-up with the balancing ring opposite the imbalance or heavy side 160 of the wash basket. Since these two critical natural frequencies occur first because of the tuned suspension at relatively low motor speeds, the balancing ring will achieve this initial desired balancing effect early in the speed cycle. This is because the centrifugal forces acting on the balancing mass and the eccentricity of the spin axis each remain small at low speeds. Therefore, a correctly tuned suspension structure quickly achieves balancing ring effectiveness at low motor speeds to reduce displacement of the wash basket caused by the heavy side out condition described above.

The last that is to develop a further ramp up speed profile for the motor that will increase the motor speed to the final spin speed as quickly as possible and yet at a rate that does not move the balls from the correctly positioned balancing condition opposite the load imbalance 160 of the wash basket. Ramping up too slowly unnecessarily increases the cycle time for the spin cycle. Ramping up too quickly will cause the balancing mass of the balancing ring to move on unnecessarily and add to instantaneous imbalance and thus displacement of the wash basket.

Figure 8:
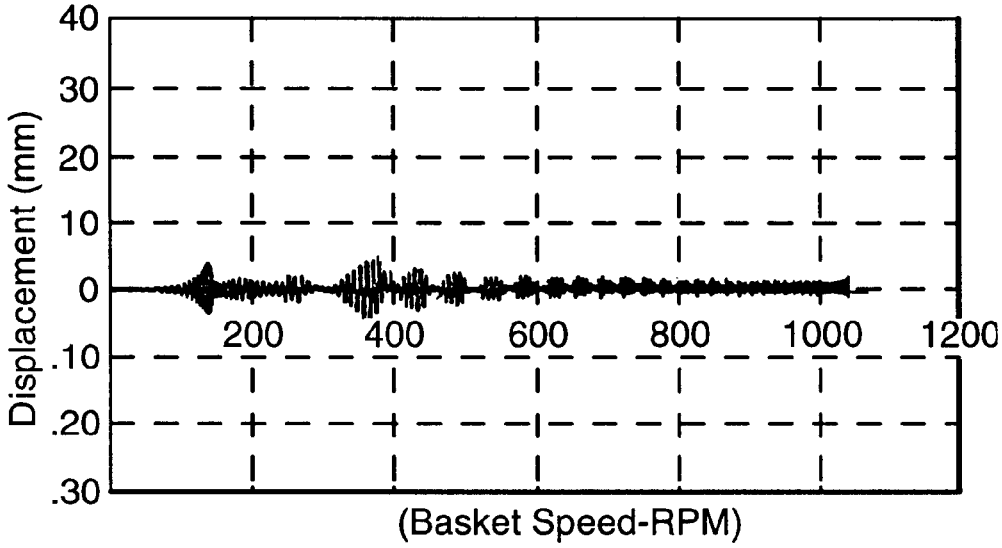
FIG. 8 is a graphic representation of wash basket displacement over a range of basket speeds for a washing machine that does not include aspects of the invention.
Figure 9:
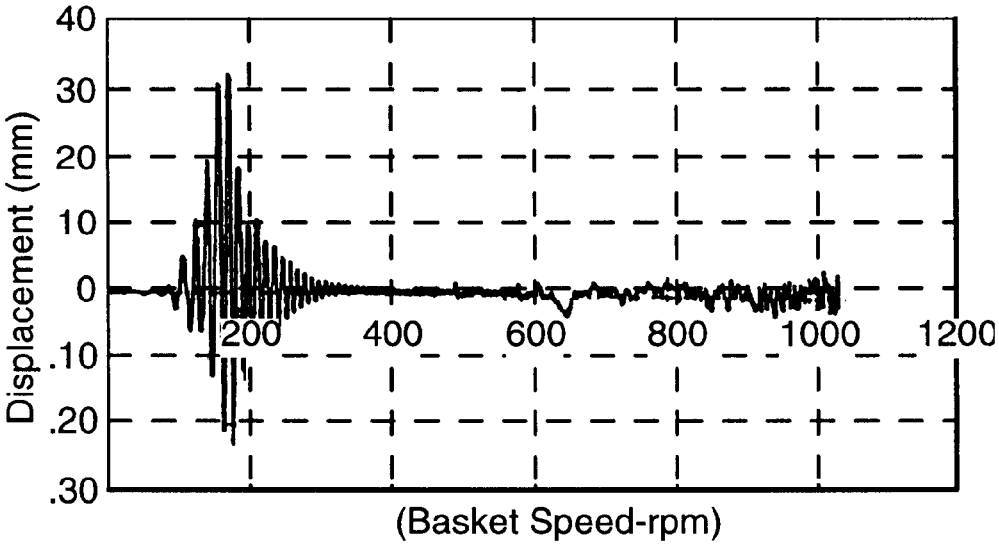
FIG. 9 is a graphic representation of wash basket displacement over a range of basket speeds for a washing machine utilizing aspects of the invention.

FIG. 8 illustrates a graphic representation of wash basket displacement charted over a range of rotational speeds during ramp up from a stopped condition to a final spin speed of about 1050 revolutions per minute (RPM). In FIG. 8, the graph represents displacement for a conventional washing machine that does not utilize a tuned suspension and motor controller profile of the invention. As can be seen, between the 150 RPM and 300 RPM low speed range, displacement of the wash basket is significant. Near 175 RPM, displacement of the wash basket is as high as 55–60 mm from one extreme to the other. FIG. 9 illustrates a washing machine incorporating the ramp up speed control and tuned suspension method of the invention as a graphic representation of wash basket displacement from a standstill to full speed. Wash basket displacement is significantly reduced by the invention. In the 150–300 RPM range, wash basket displacement is no greater than 10 mm from one extreme to the other. Wash basket displacement during ramp up from the initial spin speed to the final speed increased slightly until about 400 RPM but achieved only a total displacement of about 10 mm. Full speed displacement is also reduced slightly as can be seen from a comparison of the graphs of FIGS. 8 and 9 for a washing machine utilizing the tuned suspension and speed ramp up according to the invention.

FIGS. 8 and 9 represent an example utilizing a vertical axis washing machine such as that disclosed in FIGS. 1 and 2. FIGS. 8 and 9 also represent a balancing ring in the form of a ball balancer.

Figure 10:
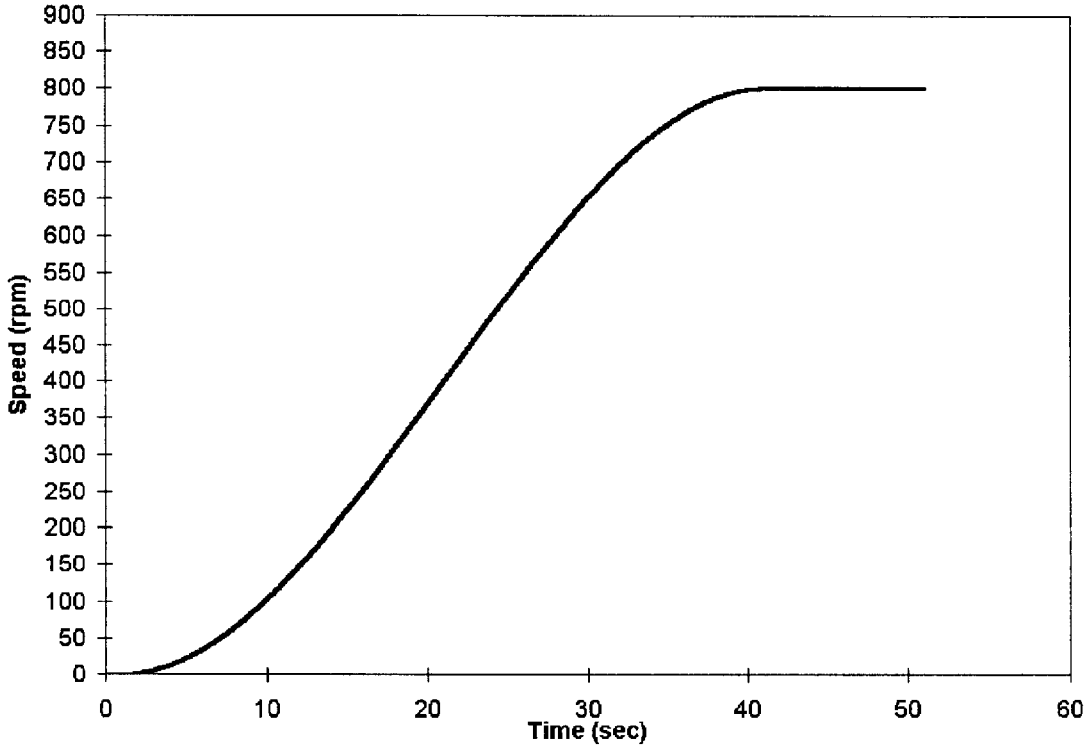
FIG. 10 is a graphic representation of the rotational speed of a wash basket over a period of time and representing a particular motor speed ramp up profile.
Figure 11:
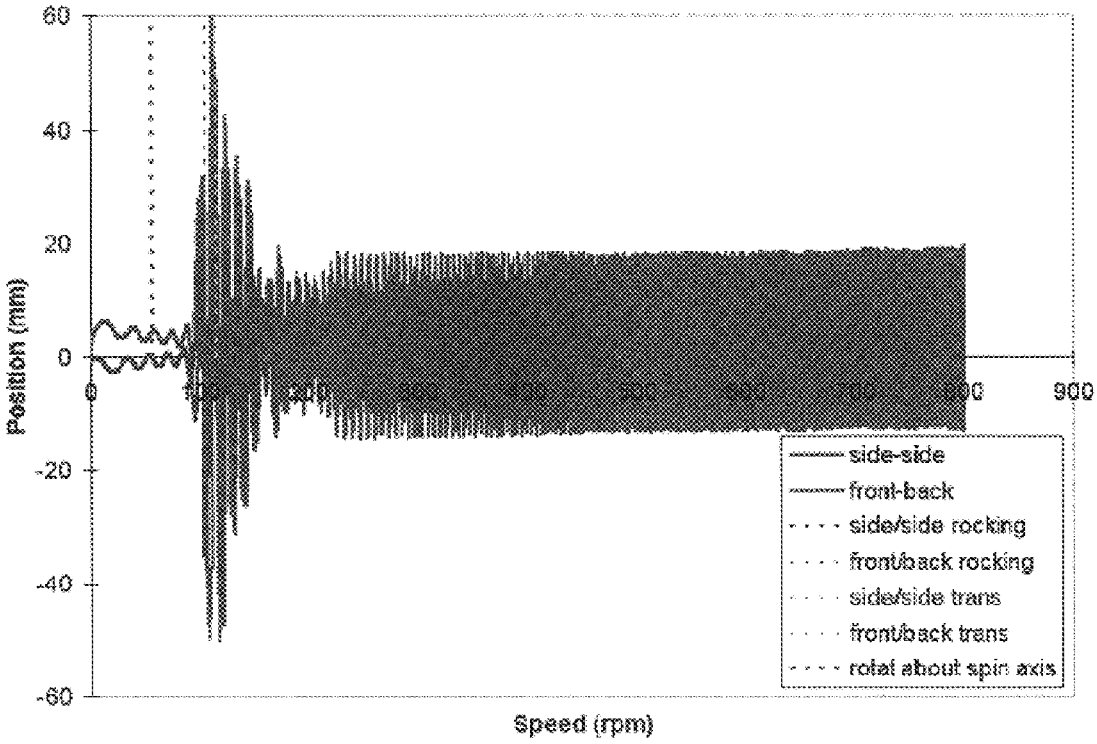
FIG. 11 is a graphic representation of wash basket position over a range of motor speeds without incorporating aspects of the invention and in conjunction with the speed ramp up profile of FIG. 10.

FIG. 10 illustrates one embodiment of the ramp up profile for a washing machine motor such as the motor 124 of the machine 106 or the motor 100 of the machine 20. The controller 170 illustrated schematically in FIGS. 1 and 3 can be electronically coupled with the motor of the washing machine. The controller can be programmed to determine a set ramp up profile for the motor. In FIG. 10, the motor includes a relatively smooth ramp up curve with no dwell time and the first initial speed setting. FIG. 11 represents a graphic of wash basket displacement over a range of speeds from a standstill to about 800 RPM for a washing machine wherein the motor was ramped up according to the profile of FIG. 10. The washing machine represented by the graph of FIG. 11 does not include a tuned suspension according to the invention. As can be seen from FIG. 11, significant displacement of the wash basket occurs at about 100 RPM on the order of 100 to 120 mm. This is the point at which the critical translational natural frequencies that are perpendicular to the rotational axis of the wash basket come into play. For this graph, the suspension is not tuned and therefore these critical natural frequencies are higher than the rotational natural frequencies of the suspension structure.

Figure 12:
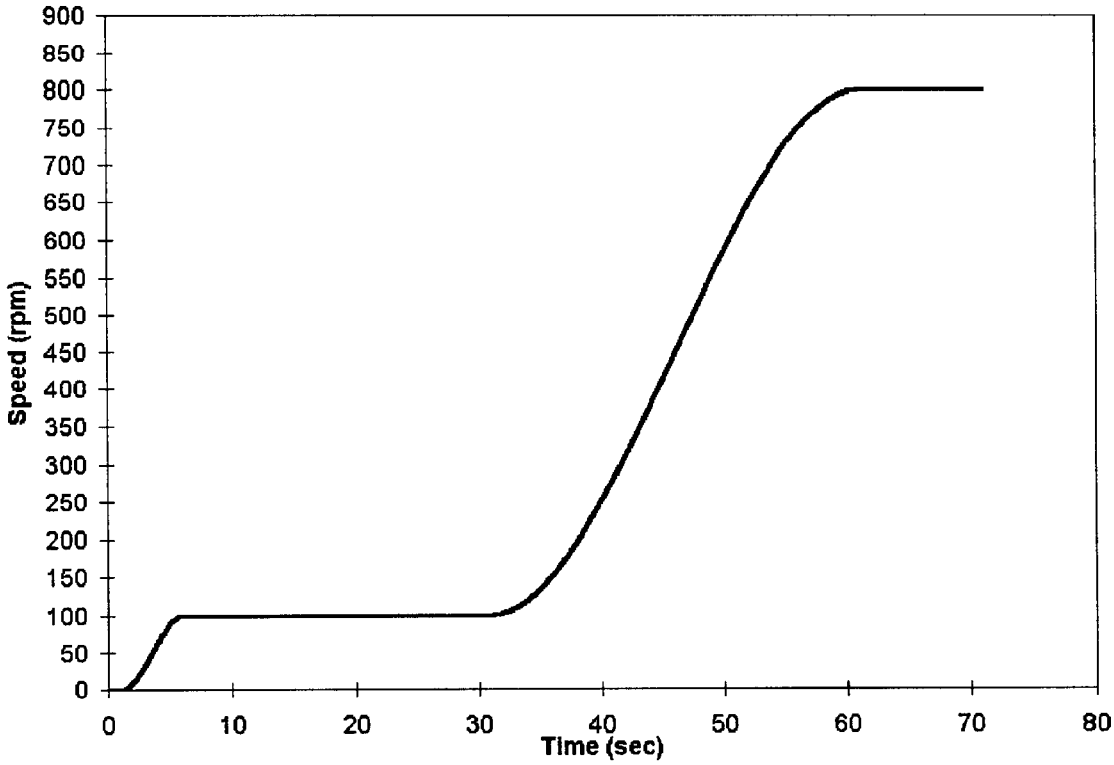
FIG. 12 is an alternative ramp up profile according to the invention for the motor speed of the wash basket.
Figure 13:
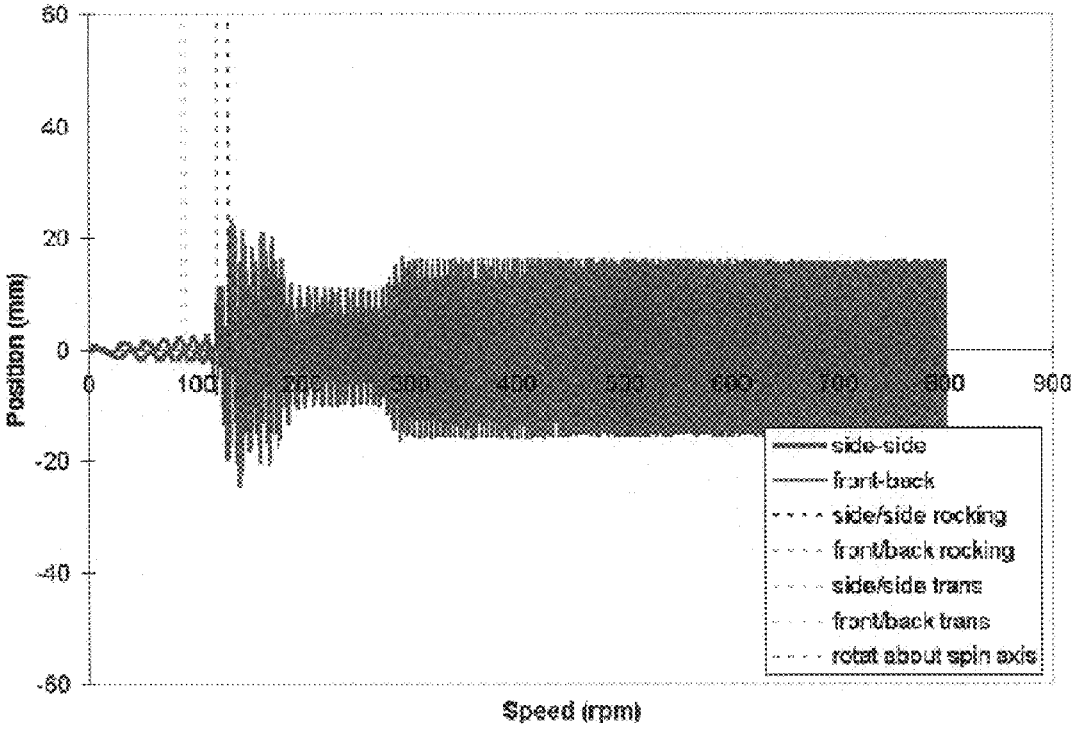
FIG. 13 is a graphic representation of wash basket position over a range of motor speeds without utilizing a tuned suspension structure and method of the invention and in conjunction with the speed ramp up profile of FIG. 12.
Figure 14:
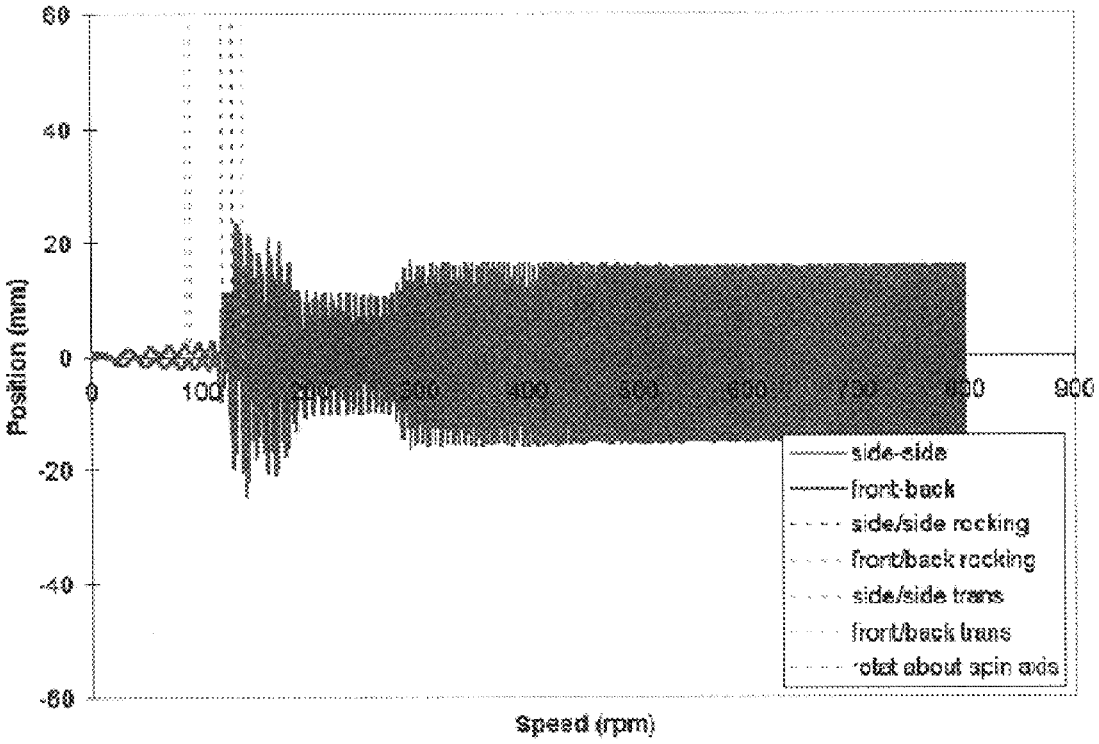
FIG. 14 is a graphic representation of wash basket position over a range of motor speed for the ramp up profile illustrated in FIG. 10, and wherein the wash basket incorporates a suspension structure and method according to the invention.

FIG. 12 illustrates an alternative ramp up profile for a drive motor of a washing machine wash basket. The controller 170 is electronically coupled to the motor in order to control the speed profile. In this particular embodiment, The motor is initially ramped up from a standstill to an initial spin speed of about 100 RPM and held for a period of about 30–35 seconds in order to permit the balancing mass within the balancing ring to settle and "lock-up". However, FIG. 13 illustrates a graphic representation of wash basket displacement for a washing machine that uses this speed profile but does not incorporate a tuned suspension structure according to the invention. As can be seen, the controlled ramp up that dwells at the initial spin speed improves the displacement of the wash basket before and after reaching the first critical speed, here about 100 RPM, for the two critical natural frequencies. The displacement at the critical natural frequencies however is still quite large, on the order of about 90–110 mm. FIG. 14 illustrates a graphic representation of wash basket displacement for a washing machine over a range of motor speeds wherein the machine includes a tuned suspension structure according to the invention. However, the ramp up profile of the motor for the embodiment of the machine represented by FIG. 14 is represented by the profile of FIG. 10 but is a fairly Smooth ramp up to the maximum speed of about 800 RPM. As can be seen, the tuned suspension structure significantly reduces wash basket displacement. At the critical natural frequencies which are now lower than the rotational natural frequencies of the suspension structure, the wash basket displacement is about 40–45 mm or better than a 50% improvement over the machine represented by FIG. 11.

Figure 15:
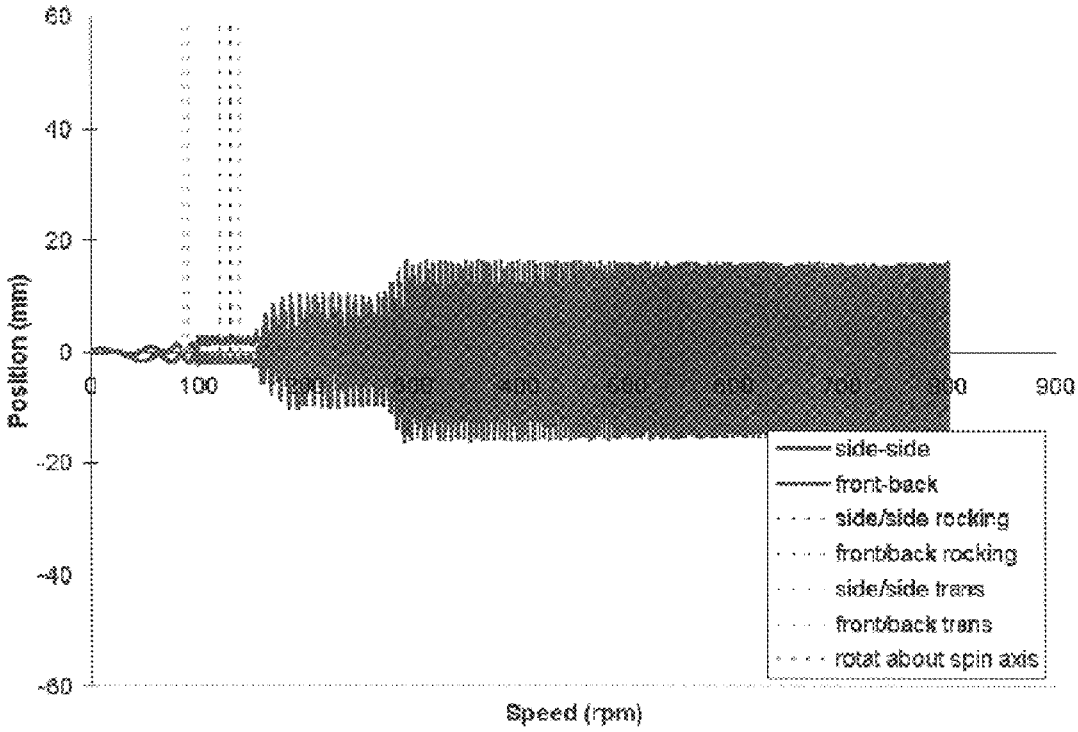
FIG. 15 is a graphic representation of wash tub position over a range of speeds utilizing the motor speed ramp-up profile of the invention and illustrated in FIG. 12, and wherein the wash basket incorporates a suspension structure and method according to the invention.

FIG. 15 represents wash basket displacement for a washing machine over a range of speeds wherein the machine includes both a controlled ramp up profile and a tuned suspension structure according to the invention. The ramp up profile for the motor speed is represented by FIG. 12. As can be seen in FIG. 15, wash basket displacement at low speeds from 0 to about 150 RPM has been virtually eliminated. Displacement is on the order of about 5–10 mm or a 90–95% improvement over the machine represented by FIG. 11. After dwelling at a low initial speed, the motor is ramped up after a 30–35 second dwell period to the maximum final spin speed of about 800 RPM. the DISPLACEMENT profiles much improved at lower speeds and is virtually identical to that for the embodiment of the machine in FIG. 14 after ramping up the motor up to full speed.

Therefore, one embodiment of the invention involves tuning the suspension structure as the struts 150 of the machine 106 or the struts 104 of the machine 20 said that the critical natural vibration frequencies for the two translational degrees of freedom perpendicular to the axis of rotation each occur prior to all three of the rotational degree of freedom frequencies. The significantly improved and reduced wash basket displacement by incorporating a tuned suspension according to the invention can be seen in comparing wash basket displacement in FIG. 14 to that of FIG. 11.

Another embodiment of the invention involves incorporating the motor speed controller 170 that can be programmed to ramp-up the motor speed to an initial low speed and hold or dwell the motor at that speed until the balancing mass locks up with the ring prior to ramping up the motor to a final or steady state spin speed. Simply by incorporating this controlled ramp up profile as represented by FIG. 12, some improvement in reduction in wash basket displacement is achieved. This improvement is represented by comparing the results of FIG. 13 to FIG. 11. The motor is subsequently ramped up from the initial low speed to the final speed at a rate that holds the balancing mass in the same position relative to the ring during ramp up and while spinning at the final speed.

In another embodiment of the invention, the washing machine has the tuned suspension structure that renders the critical natural frequencies for the two translational degrees of freedom so that they occur at the lowest motor speed in comparison to the three natural frequencies for the rotational degrees of freedom of the system. In addition, the washing machine has the controlled motor speed ramp up profile as represented by FIG. 12. By incorporating each of these elements, significant reduction of wash basket displacement is achieved during ramp up of the wash basket to full speed condition. Full benefit of incorporating each of these elements is represented in comparing the wash basket displacement characteristics of FIG. 15 to those of FIG. 11.

The method and apparatus of the present invention can be utilized in washing machines that rotate about a horizontal axis, a vertical axis or a tilted axis. The present invention can also be utilized for washing machines that incorporate balancing rings of virtually any construction. Ball balancers, liquid balancers, or combinations thereof can be utilized and performance can be significantly improved by incorporating the aspects of the present invention.

Modifications and changes can be made to the embodiments disclosed for the present invention. These modifications and changes are intended to fall within the scope and spirit of the present invention. The invention is therefore intended to be limited only by the scope of the appended claims.

The embodiments of the invention in which an exclusive property or privilege is claimed are defined as follows:

1. A method of reducing displacement of a wash basket that is rotatable about an axis of rotation within a washing machine, the washing machine having a drive motor for rotating the wash basket, the method comprising:

mounting a balancing ring to the wash basket in a plane that is generally perpendicular to the axis of rotation, the balancing ring having a balancing mass that is movable relative to the balancing ring;

supporting the wash basket by a suspension structure to the washing machine;

determining two resonant critical frequencies for two transnational degrees of freedom of the suspension structure that are generally in the plane of the balancing ring;

determining three resonant rotational frequencies for three rotational degrees of freedom of the suspension structure;

tuning the suspension structure so that the two critical frequencies of translation each occur at or below the critical first motor speed, and so that the three frequencies of rotation occur at or above a second motor speed that is above the first motor speed.

2. The method of reducing displacement according to claim 1, further comprising the steps of:

initially ramping up the motor to an initial spin speed for rotating the wash basket wherein the initial spin speed is incrementally higher than the first motor speed and lower than the second speed;

dwelling the motor for a time period at the initial spin speed until the balancing mass moves within the ring to a correcting position that offsets any imbalance of the wash basket; and subsequently ramping up the motor to a steady state final spin speed that is above the second speed for rotating the wash basket.

3. The method of reducing displacement according to claim 2, wherein the steps of ramping up further comprises:

ramping up the motor at a rate that permits the balancing mass to remain in the correcting position relative to the balancing ring while ramping-up as well as after reaching the steady state final spin speed.

4. The method of reducing displacement according to claim 2, further comprising the steps of:

coupling a controller to the motor that is capable of controlling the speed of the motor to accomplish the steps of initially ramping up, dwelling and subsequently ramping up the motor speed.

5. The method of reducing displacement according to claim 1, wherein the step of mounting further comprises:

mounting a fluid balancing ring having an annular chamber and a balancing fluid held within the chamber and movable around the chamber.

6. The method of reducing displacement according to claim 1, where the step of mounting further comprises:

mounting a ball balancing ring having an annular chamber and both a viscous fluid and a plurality of weighted balls held within the chamber and movable around the chamber.

7. The method of reducing displacement according to claim 1, wherein the wash basket is rotatable about a generally vertical axis.

8. The method of reducing displacement according to claim 1, wherein the wash basket is rotatable about a generally horizontal axis.

9. A washing machine comprising:

a) a wash basket that is rotatable about an axis relative to the washing machine;

b) a drive motor for rotating the wash basket;

c) a balancing ring mounted to the wash basket in a plane that is generally perpendicular to the rotation axis, the balancing ring having a balancing mass that is movable relative to the balancing ring; and d) a suspension structure mounted to the washing machine and supporting the wash basket, the suspension structure having, i) two resonant critical frequencies for two transnational degrees of freedom of the suspension structure that are generally perpendicular to the axis of rotation that each occur at or below a critical first motor speed, and ii) three other resonance frequencies for three rotational degrees of freedom of the suspension structure that each occur at or above a second motor speed that is higher than the first speed.

10. The washing machine according to claim 9, further comprising:

a motor controller that i) initially ramps up the motor to an initial spin speed that is incrementally higher than the first motor speed and lower than the second motor speed, ii) dwells the motor at the initial spin speed until the balancing mass of the balancing ring is repositioned to reduce any imbalance in the wash basket, and, iii) subsequently ramps up the motor to the steady state final spin speed that is higher than the second motor speed.

11. The washing machine according to claim 10, wherein the motor controller finally ramps up the motor at a rate that permits the balancing mass to remain in the same correcting position relative to the balancing ring while ramping up as well as after reaching the steady state final spin speed.

12. The washing machine according to claim 9, wherein the balancing ring comprises a fluid balancing ring having an annular chamber and the fluid held in the chamber and movable around the chamber.

13. The washing machine according to claim 9, wherein the balancing ring comprises a ball balancing ring having an annular chamber and both a viscous fluid and a plurality of weighted balls held in the chamber and movable around the chamber.

14. The washing machine according to claim 9, wherein the wash basket is rotatable about a generally vertical axis.

15. The washing machine according to claim 9, wherein the wash basket is rotatable about a generally horizontal axis.

16. A method of reducing displacement of a wash basket that is rotatable about an axis of rotation within a washing machine, the washing machine having a drive motor for rotating the wash basket, the method comprising:

mounting a balancing ring to the wash basket in a plane that is generally perpendicular to the axis of rotation, the balancing ring having a balancing mass that is movable relative to the balancing ring;

supporting the wash basket by suspension structure to the washing machine;

determining two resonant critical frequencies for two translational degrees of freedom of the suspension structure that are generally in the plane of the balancing ring; and initially ramping up the drive motor to the initial spin speed that is above a first motor speed at or below which each of the critical frequencies occurs;

dwelling the drive motor at the initial spin speed for a time period that permits the balancing mass to move relative to the balancing ring and to lock up with the balancing ring; and subsequently ramping-up at the drive motor to a final steady state spin speed at a rate that permits the balancing mass to remain generally stationary relative to the balancing ring while ramping up as well as after reaching the steady state final spin speed.

17. The method according to claim 16, further comprising the step of:

coupling a programmable motor controller to the drive motor for controlling the ramping up and the dwelling steps.

* * * * *